US008343015B2

(12) United States Patent
Zachary

(10) Patent No.: US 8,343,015 B2
(45) Date of Patent: Jan. 1, 2013

(54) HAND EXERCISE DEVICE

(76) Inventor: Terry Zachary, Langley (CA)

( * ) Notice: Subject to any disclaimer, the term of this patent is extended or adjusted under 35 U.S.C. 154(b) by 791 days.

(21) Appl. No.: 11/887,200

(22) PCT Filed: Mar. 24, 2005

(86) PCT No.: PCT/CA2005/000474

§ 371 (c)(1),
(2), (4) Date: Sep. 27, 2007

(87) PCT Pub. No.: WO2006/099711

PCT Pub. Date: Sep. 28, 2006

(65) Prior Publication Data

US 2012/0065027 A1 Mar. 15, 2012

(51) Int. Cl.
*A63B 23/16* (2006.01)

(52) U.S. Cl. ..... 482/48; 482/47

(58) Field of Classification Search ..... 482/44, 482/45, 46, 47, 48, 49, 121, 122, 124, 907; 601/40; D21/662, 684

See application file for complete search history.

(56) References Cited

U.S. PATENT DOCUMENTS

| | | | | |
|---|---|---|---|---|
| 5,058,885 | A * | 10/1991 | Brant | 482/48 |
| 5,062,625 | A * | 11/1991 | Vonk | 482/48 |
| 6,217,504 | B1 * | 4/2001 | Phillips | 600/9 |
| 6,228,001 | B1 * | 5/2001 | Johnson et al. | 482/48 |
| 6,817,967 | B1 * | 11/2004 | Ott et al. | 482/48 |

FOREIGN PATENT DOCUMENTS

CA 2200648 * 9/1998

* cited by examiner

*Primary Examiner* — Loan Thanh
*Assistant Examiner* — Tam Nguyen

(57) ABSTRACT

The present invention relates to an exercise device that allows the user to strengthen the muscles that close the hand, against the resistance of a flexion member, as well as to strengthen the muscles that open the hand and spread the digits, against resistance of an extension member, all through full natural planes of motion, without lulls of resistance during the exercise. The device is always taut, due to its unique design, either resisting finger and thumb flexion and adduction or finger and thumb extension and abduction. The result of consistent use is maximum strength, balance and blood flow to the hand, wrist, forearm and elbow.

14 Claims, 7 Drawing Sheets

FIGURE 7
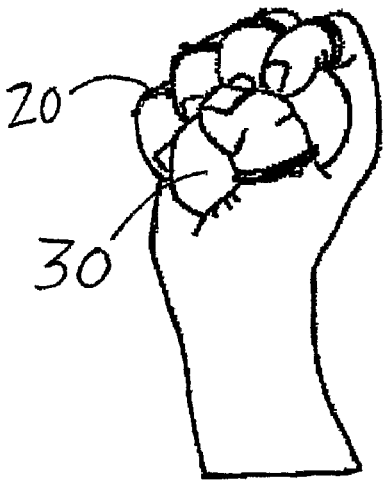
FIGURE 8
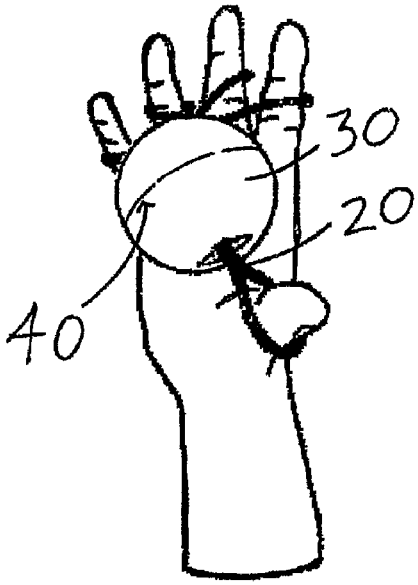
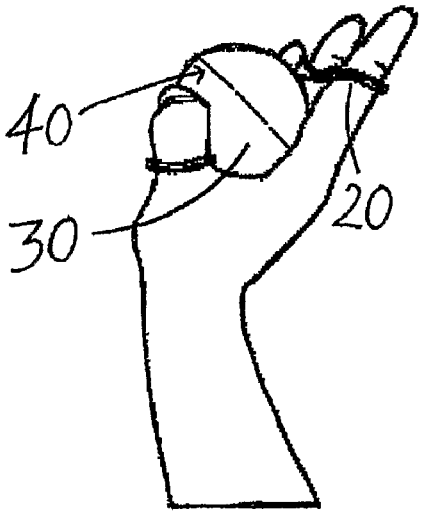
FIGURE 9
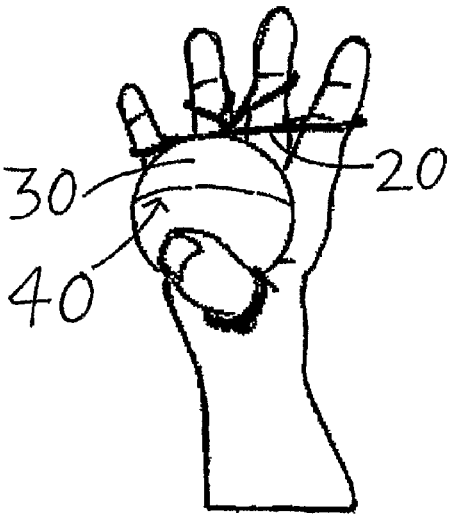
FIGURE 10

FIGURE 11
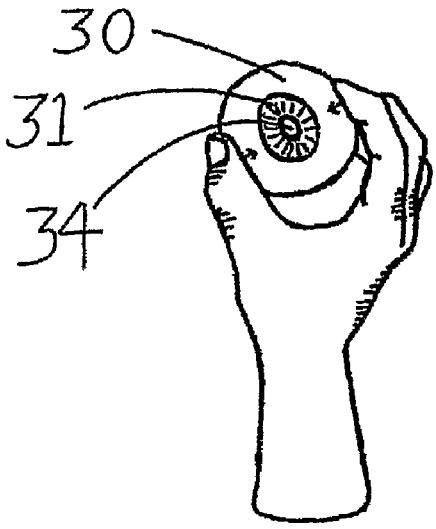
FIGURE 12
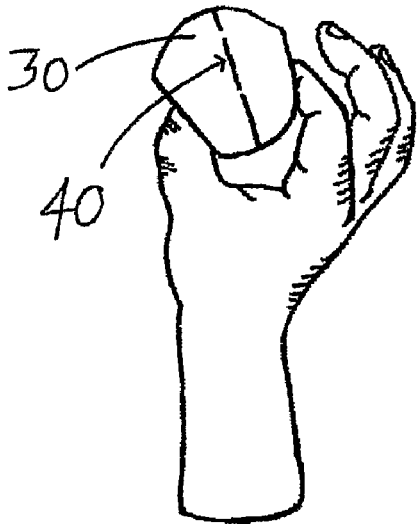
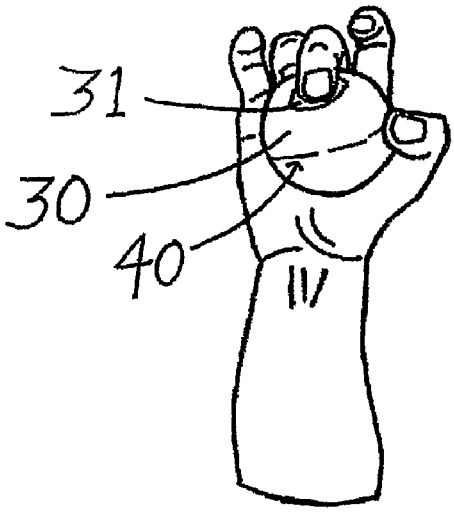
FIGURE 13
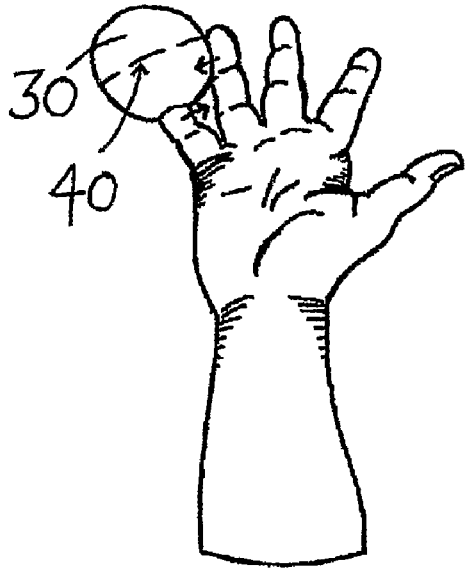
FIGURE 14

FIGURE 15
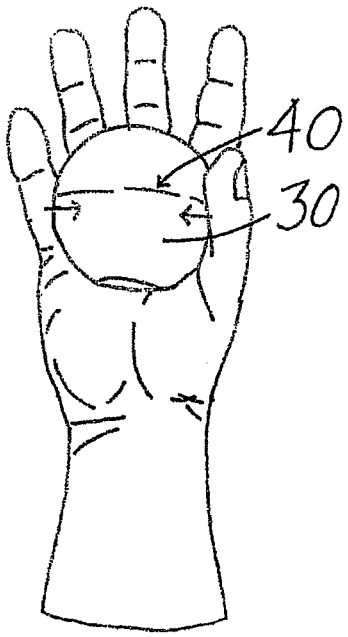
FIGURE 16
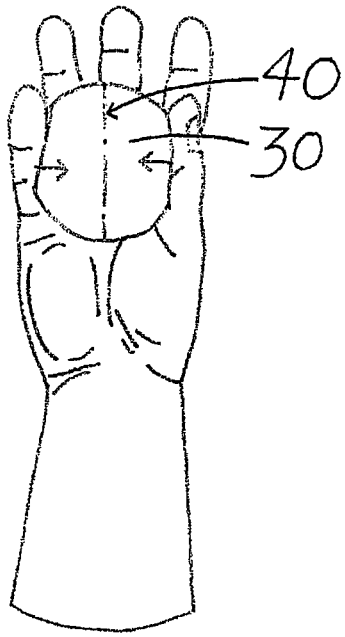
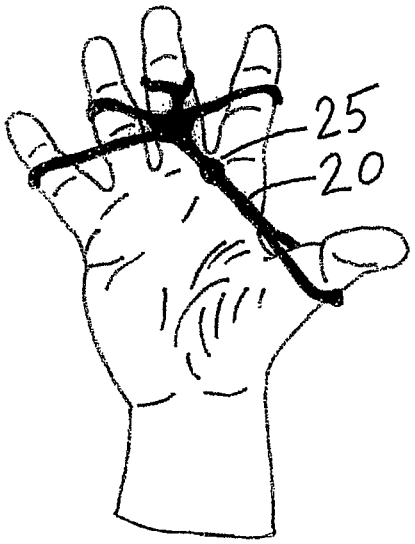
FIGURE 17
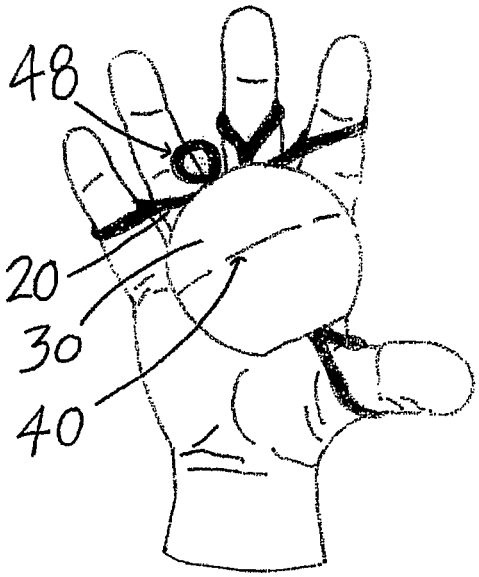
FIGURE 18

HAND EXERCISE DEVICE

CROSS REFERENCE TO RELATED APPLICATIONS

This application is a national stage entry of PCT/CA2005/000474 having an international filing date of Mar. 24, 2005.

FIELD OF THE INVENTION

The present invention relates to an exercise device that allows the user to strengthen the muscles that close the hand, against the resistance of a flexion member, as well as to strengthen the muscles that open the hand and spread the digits, against resistance of an extension member, all through full natural planes of motion, without lulls of resistance during the exercise. The device is always taut, due to its unique design, either resisting finger and thumb flexion and adduction or finger and thumb extension and abduction. The result of consistent use is maximum strength, balance and blood flow to the hand, wrist, forearm and elbow.

The device is beneficial to medical doctors, chiropractors, therapists, athletic trainers and other health care professionals, as well as to athletes, musicians, workers and the general population to enhance performance, prevent injury and rehabilitate injury. By allowing the hand to move through its full, natural planes of motion against resistance, blood supply and peripheral nerve stimulation is also optimized to the hand, wrist and forearm.

BACKGROUND OF THE INVENTION

Many hand, wrist and forearm conditions result from the original causative factor of muscular weakness, muscular imbalance and chronic avascularity (lack of blood supply) to the muscles and tissues. Traumatic injuries, both acute and cumulative, lead to pain, chronic adhesion and scarring. Proper preventative and rehabilitative exercise procedures applied to the lower arm, wrist and hand are vital and have historically been ignored.

The present device provides a diverse solution to address these problems, as it allows the hand to be moved through a full, natural 3-dimensional planes of motion, against resistance at all times, and respects reciprocal muscle group balance. Daily use of the device will improve muscle strength, muscle balance, blood supply and lymph drainage, and stimulate all peripheral nerve roots to the hand muscles. Full natural range of motion training also ensures the development of healthy, elongated muscle tissue. The device is effective at reducing treatment times, as well as reducing the risk of future injury. To couple the resistance of many planes of motion into few continuous exercises is convenient for the user.

Standard treatment applications include carpal tunnel syndrome, tennis elbow, golfer's elbow, tendonitis, stroke rehabilitation, sprain/strain/fracture rehabilitation, osteoarthritis, osteoporosis, DeQuervain's Syndrome, RSI's (repetitive stress injuries) and neuropathies, among many others.

It is very rare to see athletes, musicians and workers properly train their hands and hand muscles for their given activity. While it is true that many athletes, musicians and workers strengthen grip strength (or the closing of the hands), it is very rare that even the most elite athletes strengthen the finger and thumb extensor and abductor muscles (opening muscles). This is an extremely important point because the lack of a balanced hand training approach means that the stronger flexor muscles of the hand dominate the weaker opposing extensor muscles, leading to hand muscle imbalance and eventually to performance limitations and the greater risk of injury.

There are approximately nine muscles that open the hand and nine muscles that close the hand. These muscle groups are opposing in nature, and attach throughout the lower arm (fingers, thumb, hand, wrist, forearm and elbow). A great imbalance will exist at the joints of the fingers, thumbs, wrists, forearms, and elbows when the hand muscles are imbalanced.

Additionally, when only the gripping motion is resisted, the hand is never exercised through its entire range of its extension and abduction motions. The result is that the tissues (muscle, tendon, ligament) and joint surfaces (cartilage) relating to the extension and abduction action of the hand develop a condition of avascularity. They are weaker and more easily injured. The phrase "move it or lose it" refers to the body supplying less nutrients and oxygen to areas that it does not use regularly. This device is an all around reciprocal muscle group training solution for the hand, wrist, elbow and forearm.

Athletes that would benefit from the device participate in golf, tennis/racquet sports, basketball, baseball, hockey, football, climbing, motor sports (motor-cross, jet-ski, snowmobile, auto-racing, etc.), bowling, cricket, martial arts, body building, sailing, arm-wrestling, to name a few. Musicians who play string instruments, piano, drums, and wind instruments, to name a few, would benefit from the device, as would workers such as cashiers, production line workers, laborers, dentists/dental hygienists, surgeons, sewing/craft workers and trades specialists (i.e. carpenters).

Prior art exists which attempt to resist the closing and opening action of the hand. U.S. Pat. No. 6,228,001 (Johnson et al) shows a device that does not allow the muscles of the hand to move through its full, natural planes of motion. Firstly, the central flexion resistance member is too small to resist much of the flexion range of motion (i.e. the hand does not close in a small circle). Secondly, the product is too small to allow the fingers and thumbs to be extended and abducted fully. Thirdly, the design of the finger engaging outside rim does not control the resistance vectors that would respect the resistance to the natural centrally resisted vectors of the extension and abduction motions of the fingers and thumb. Additionally, the extension and abduction action required cannot be independently controlled separate of the flexion action, as the extension and abduction cords are not interchangeable with the central sphere.

U.S. Provisional Application 60/222,796 (mine previous) does not work. The central cord structure does not resist extension/abduction in a natural means, as resistance to finger and thumb extension and abduction begins at the top and bottom of the flexion member (ball) respectively, as opposed to from a more central natural location. The current design couples the resistance to both abduction and extension of the digits, as opposed to mostly abduction, as in the said prior art.

As well, because of the distance between the ball's horizon and the central flexible cord's finger and thumb loops in U.S. Pat. No., there is a lull in resistance as the exercise transfers from gripping to the extension and abduction action and vice versa. The current device provides a "buried web" design, allowing the finger and thumb loops (or holds) to be located on the horizon of the flexion member. An alternate embodiment may attach the finger and thumb loops directly to the flexion member and respects the proper resistance vectors of both motions. The present device, using the buried web design, ensures that resistance is always offered at any point of the exercise, yet still allows the extension member to be removable.

Additionally, the design of U.S. Provisional Application 60/222,796 structurally causes extremely quick breakdown of the flexion member due to the degree of friction of the extension member on the flexion member during use. The current "buried web" and "volcano exits" design removes the friction-prone portion of the flexion member where the extension member exits. The result is reduced device breakdown.

Another benefit of the current design of the flexion member is that, by itself, it provides proper resistance to the pinching action, interphalangeal flexion action and opposition action of the fingers and thumb. These exercises were not possible with U.S. Provisional Application 60/222,796. The current invention will have more diversity to health care professionals, as well as athletes, musicians, workers and the general public. A user can train wide pinch by pinching the outside body of the ball, medium pinch by inserting both the thumb and said finger into both volcano cord exits, and narrow pinch by inserting said finger into volcano cord exit and thumb on the ball surface. Both wide and narrow opposition can be resisted. Interphalangeal flexion can be resisted using any digit, mimicking the action of the cording hand, for example, for guitarists and violinists.

The volcano design of the flexion member also allows the extension member to be loaded into the product easily by hand, without the use of a wire hook, as is the case in U.S. Provisional Application 60/222,796. The extension member must be inserted when it is changed for reasons of size or resistance preference, or when the extension member is accidentally displaced from the flexion member.

Another major problem with U.S. Provisional Application 60/222,796 was that the extension member was easily dislodged from the flexion member. The current invention boasts an extension member that includes a "friction belly" expansion, which secures the extension member into the flexion member during use, yet still allows for interchangeability of extension member within the flexion member.

U.S. Pat. No. 6,454,681 (Brassil, et al) shows a webbed glove, which is firstly awkward to put on and take off, secondly is non-interchangeable between hands, thirdly is very difficult and complicated to scale for resistances and size, and lastly, does not avail the separation of flexion and extension resistances. It would also be expensive to manufacture (and therefore to buy) and would be complicated and difficult to fit. The current inventive device is easily interchangeable for either the left or right hand, is easy to fit, has distinct resistances and is cost effective.

U.S. Pat. No. 4,750,734 (Greenfield) shows a web device which functions in only 2-dimensions of resistance, meaning that the design of the product would dictate the motion and resistances of the exercise and not the natural hand motion and its relative natural vectors. The present device allows the natural 3-dimensional motion of the hand to dictate the exercise, with appropriate natural resistances.

BRIEF SUMMARY OF THE INVENTION

The device is comprised of a specially designed central resistance mass, called the flexion member (as it resists digit flexion, opposition and adduction), through which centrally is passed a specially designed flexible resistance cord, called the extension member (as it resists digit extension and spreading). The extension member attaches to the user's fingers and thumb such that the user is prepared for resistance exercises through full, proper and natural planes of motion. Both are unique, as their individual shapes couple to form an exercise unit that not only specifically resists the natural motions of the hand, but also provides resistance at all times throughout the exercise (no resistance lulls).

Many hand exercise devices are limited in that they only resist flexion (the gripping motion) of the hand. Most of these devices, such as coiled or spring-loaded devices, only resist flexion in two dimensions, through incomplete ranges of motion.

Various sizes of the device will respect user hand sizes. Various sizes of the device will respect the resistive principles and will better accommodate specific mechanical requirements of the exercise. For example, if the user wants to resist extension and/or abduction through a greater range of motion, that user will tend to use a smaller device, as the hand will begin the extension/abduction portion of the exercise from a more flexed and adducted position. A larger device would be used if the user desires to favor a larger range of the flexion motion to be resisted.

Various strengths of the device will respect the resistive principles set forth previously, yet will be specific to user needs. A softer product will be more appropriate for users who have recently suffered a stroke or fracture and are ready for rehabilitation to begin. This softer strength may also be more appropriate for older users, disease-stricken and handicapped individuals. As the strengths get more firm the health needs or performance needs move more towards advanced wellness, performance and strength training.

The use the device, a user will insert their thumb and then fingers into the appropriate holds. The main exercise is then accomplished by alternately squeezing against the flexion member and then opening and spreading the fingers and thumb against the resistance of the extension member.

An additional exercise isolates the interphalangeal motion of the fingers requiring the user to flex and extend only at the interphalangeal joints. This application is especially useful to those who use their fingers specifically during their daily activities, for example, climbers, guitar players and seamstresses.

An additional use of the device provides resistance to all muscles that originate from the lateral epicondyle (finger extensor and wrist extensor muscles) through full, natural planes of motion. This additional exercise application is specific for preventing and rehabilitating lateral epicondylitis (tennis elbow) as well as providing much needed strength and blood flow to the tissues of the lateral forearm. The user firstly squeezes against the resistance of the flexion member, secondly extends the fingers only (while maintaining the thumb flexed on the flexion member) and thirdly extends the wrist fully.

The user will always have the option of training individual or all fingers by placing or not placing a finger(s) in the appropriate finger loop.

The user will have the option of using only the flexion member, independent of its matching extension member partner, to perform pinching, interphalangeal flexion and adduction exercises.

The current invention also boasts an extension member design that includes a hole for the insertion of a magnet, for use of the invention for magnetic therapy. It is understood to be within the spirit of the invention to include any type of magnetic material, whether singular or multiple and/or whether imbedded in or included in the manufacturing of the flexion member or extension. Any addition of magnetic material is said to be within the spirit of the invention.

The device's flexion member may be made of polyurethane sponge or foam, rubber, elastomeric material, nylon, plastic or any other material with suitable flexible resistive and reloading qualities. It may be woven, sculpted, cut or molded (injection, baked or otherwise) in its production.

The device's extension member may be made of sponge, rubber, elastomeric material, nylon, plastic, or any other material with suitable flexible resistive and reloading qualities. It may be woven, sculpted, cut or molded (injection, baked or otherwise) in its production.

There is also an alternate embodiment for the current invention where the central flexion member is generally oblong shape, deviating somewhat from round, in accordance with the shape of the hand and its closing and opening action. Another embodiment allows shallow concave finger grooves and/or a generally rectangular shape rather than circular or oblong, allowing a guide to finger placement and comfortable placement in the palm. Outside flexion member shapes may be used for baseball, football, basketball or any other activity, yet the buried web and volcano exit combination is present.

An alternate embodiment of the device may be a one-piece unit made from any flexible resistant material, including elastomeric or plastic material and may be may be woven, sculpted, cut or produced by use of a mold (injection or otherwise).

There is an alternate embodiment where the extension member passageway is located non-centrally in the flexion member. Whether, central or non-central, these extension member passageways are both within the spirit of the invention.

DECSRIPTION OF DIAGRAMS

FIGS. 7, 8, 9 and 10 are frontal views of exercises performed with the device assembled.

FIGS. 11, 12, 13, 14, 15 and 16 are frontal views of exercises performed with the central flexion member alone, excluding the extension member.

FIG. 17 is a frontal view of an exercise performed using the extension member alone, excluding the flexion member.

FIG. 18 is a frontal view illustrating the option of omission of a finger loop, with it being understood that any single or multiple loops may be omitted.

DETAILED DESCRIPTION OF DIAGRAMS

Figure 1:
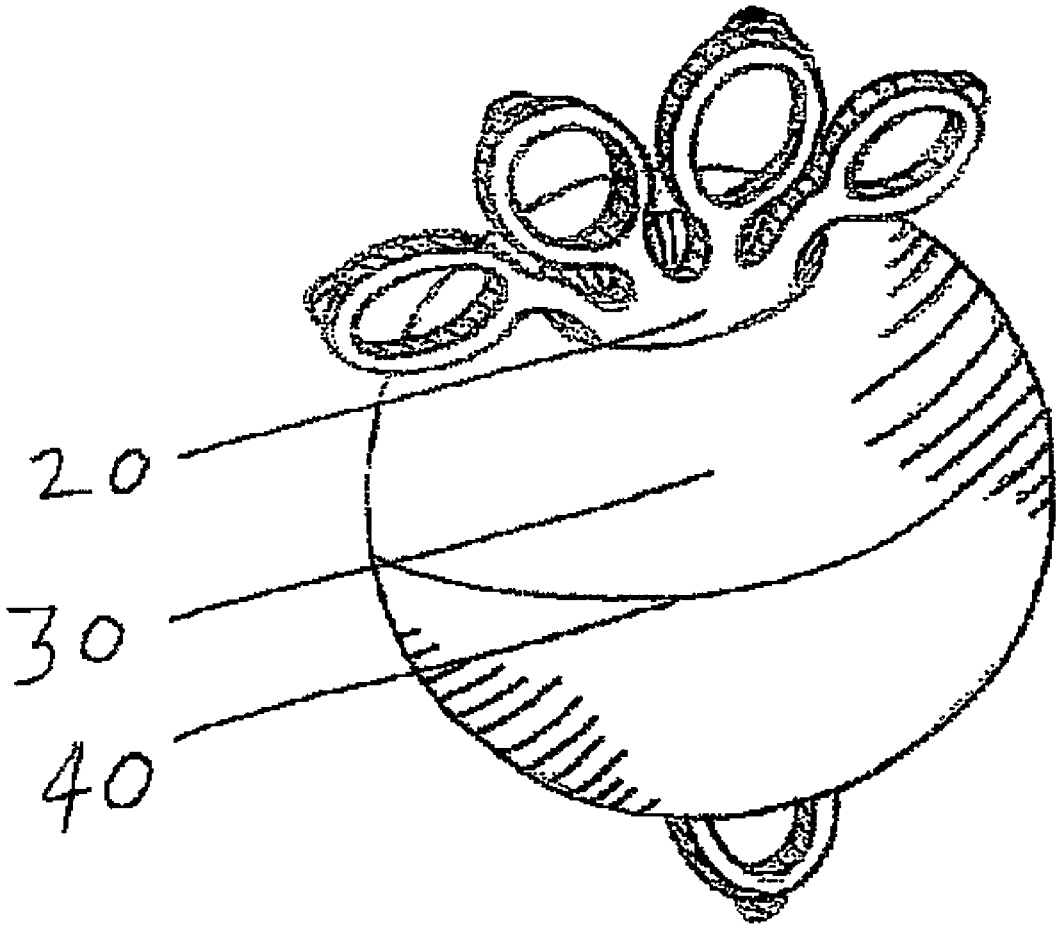
FIG. 1 is a frontal/superior view of the preferred embodiment of the invention.

FIG. 1 represents the preferred embodiment of the invention, with the extension member (20) inserted into the flexion member (30). The current invention is manufactured such that the mold seam line (40) runs horizontally, allowing convenient manufacture of the current invention, as opposed to the mold seam line running vertically, as in previous art.

Figure 2:
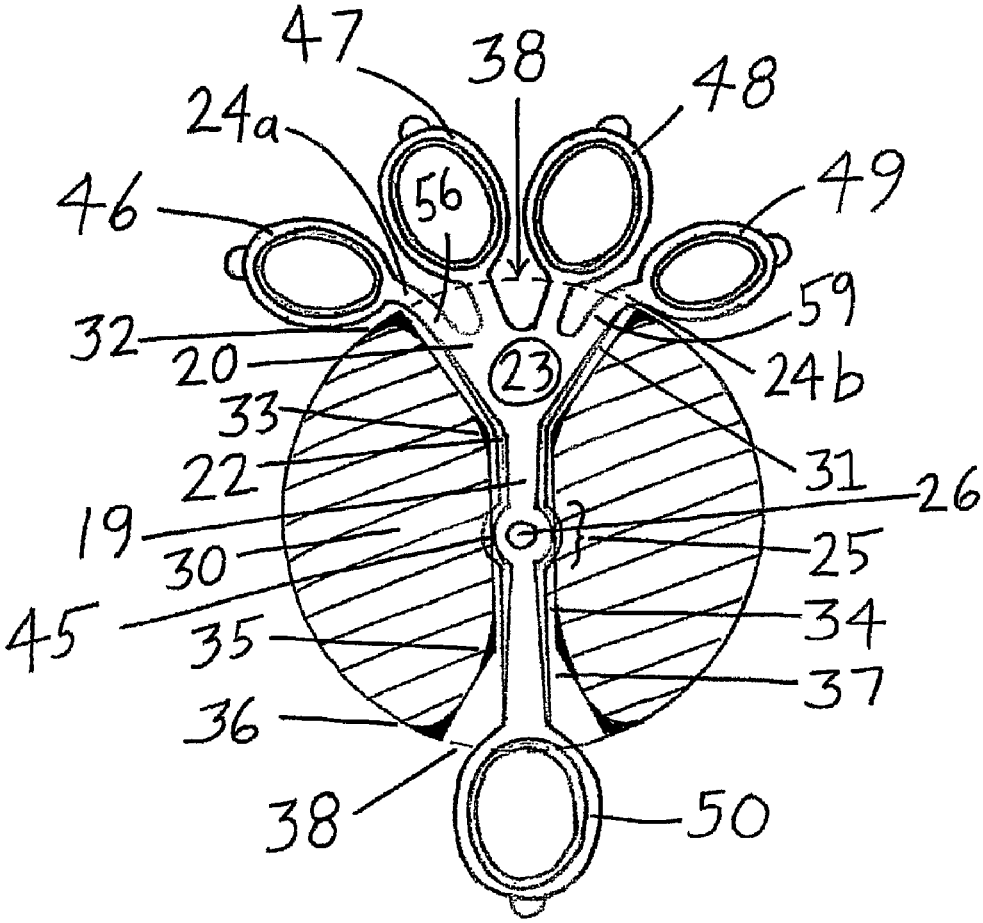
FIG. 2 is a frontal, cross-sectional view of the preferred embodiment of the invention.

FIG. 2 illustrates a cross section of the combination of the preferred embodiments of the extension member (20) together with the flexion member (30), as they fit together.

Notice, most importantly, that the web area (23) of the extension member (20) is below the horizon (38) of the surface of the central flexion member (30). This design brings the finger loops (46, 47, 48, 49) onto the horizon (38) of the surface of the flexion member (30). A wide volcano opening (31) in the flexion member (30) accepts the buried web (23). A volcano opening (37) is also present at the thumb exit, allow the thumb loop (50) to be positioned on the horizon (38) of the flexion member. This "buried web" design ensures that as the user will experience resistance throughout the full range of the hand closing and hand opening exercise, including during the transition between the hand closing and the hand opening, an accomplishment that cannot be claimed by any prior art.

Figure 6:
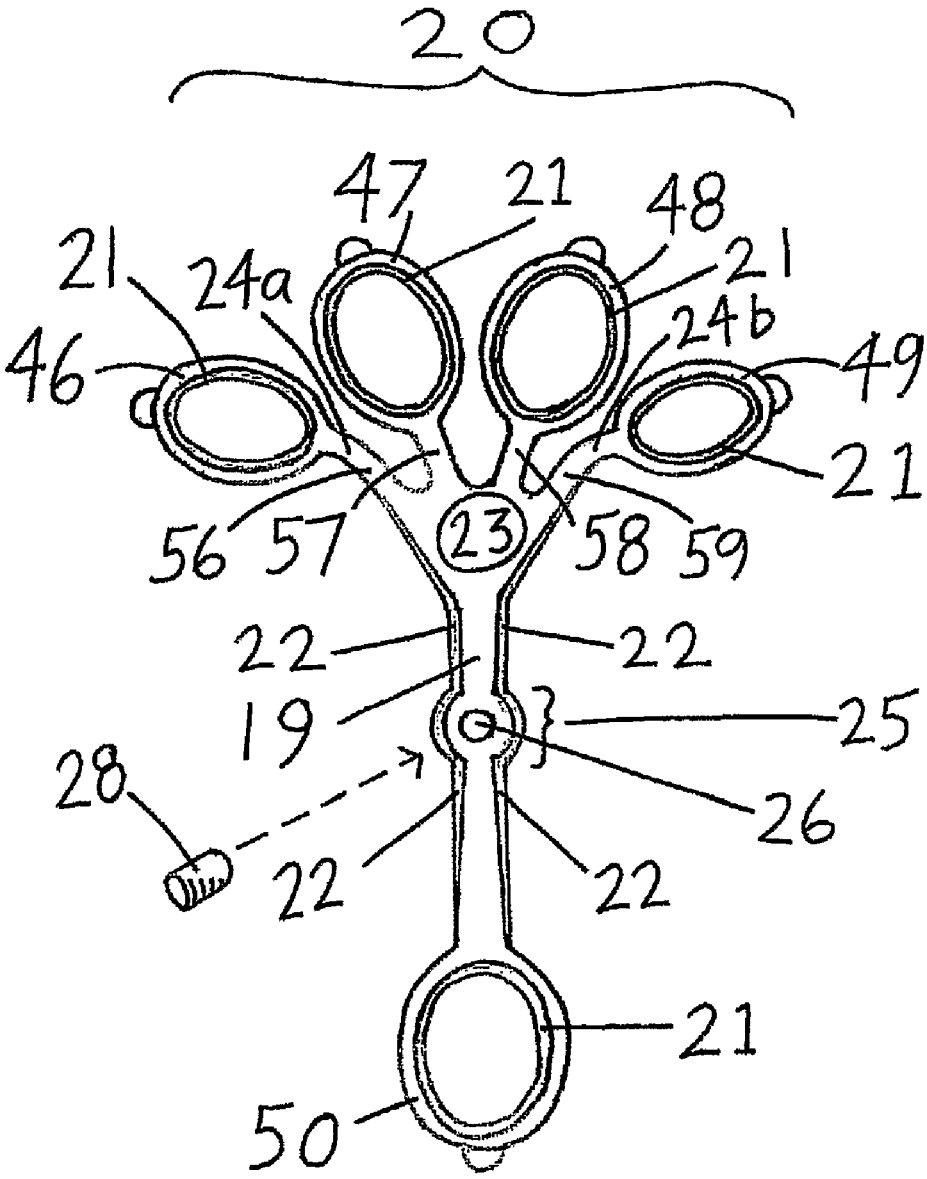
FIG. 6 is a frontal view of the preferred embodiment of extension member, illustrating, as well, the preferred embodiment for a therapeutic magnet option for the invention.

FIG. 6 also illustrates the web (23) of the extension member (20), from which all of the finger stems (56, 57, 58, 59) originate. The structure and location of the web (23) is very important in the inventive function of the current device for two reasons. As was previously discussed, the location of the web (23) allows the finger loops (46, 47, 48, 49) to be located on the horizon (38) of the flexion member (30), ensuring that there are no lulls of resistance during the transition between the flexion to extension actions in the exercise. The location of the web (23) also locates the center of resistance to finger extension and abduction to a central location within the flexion member (30), resulting in optimum coupled resistance vectors to finger and thumb extension and abduction.

FIGS. 2, 3, 4 and 5 illustrate the preferred embodiment of the structure of the central passageway through the flexion member (30) (although the member may be of any outer shape to welcome specific hand actions and functions). It consists of a narrow central passage (34) and wider volcano-like exits superiorly (31) and inferiorly (37). The length and size of the openings may vary within the flexion member and still be within the spirit of the invention. The passageway is illustrated to have smooth convex rounds at its inner corner points, including the proximal points superiorly (33) and inferiorly (35), and the distal points superiorly (32) and inferiorly (36). These round transitions all save on the wear and tear of the flexion member (30) during exercise.

Figure 5:
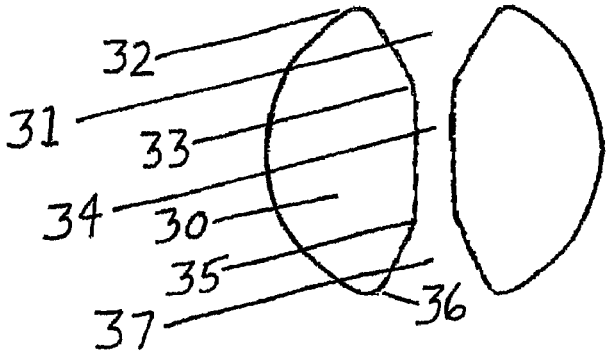
FIG. 5 is a frontal cross-sectional view of the central flexion member with extension member excluded.

FIG. 5 specifically shows the volcano exits (31, 37) of the flexion member (30), which also function to allow ease of loading the extension member (20) into the device by hand (whereby there is space for the user's finger to both transport and receive the extension member through the flexion member).

FIGS. 2 and 6 illustrate a smooth convex round (22) along the shaft (19) and web areas (23) of the flexible elastic cord (20). Three factors (volcano openings, convex rounds at passageway corners, convex rounds on the flexible cord shaft and web areas) will protect the passageway (31, 34, 37) of the flexion member (30) from wear and tear as the flexible cord (20) rubs against the passageway areas (31, 34, 37) during use.

Notice also in FIG. 6, that the insides (21) of the finger loops (46, 47, 48, 49) and thumb loop (50) are rounded convexly (21) for maximum user comfort.

FIGS. 2 and 6 best illustrate the friction belly (25), which is an expansion of the shaft (19) of the extension member (20). FIG. 2 especially illustrates how the friction belly (25) pinches or rubs against the flexion member (30) at the area of the narrow central passageway (34) causing friction between the two surfaces (45). The benefit of this coupling is that the extension member (20) is unlikely to be accidentally pulled from the flexion unit (30) during or after use, yet may still easily be removed if another extension member strength or size is desired by the user.

Note also in FIG. 6, the presence of a hole (26) at the center of the friction belly (25). It is the preferred embodiment for adding a magnet (28) to the invention, for use in magnetic therapy. It is understood that magnets, or magnetic material, can be added anywhere to or into the inventive device and still be within the spirit intended within the current invention.

FIGS. 2 and 6 illustrate the use of lateral curves (24*a*, 24*b*) to the stems (56, 59) to the two outside fingers loops (46,49). The function of these curves is to move the outside finger loops (46,49) laterally and angle them more horizontally to allow the middle two finger loops (47, 48) to be moved down onto the horizon (38) of the flexion unit (30). At the same time, note how the curved stems (56,59) also allow the two outside finger loops (46, 49) to also remain on the horizon (38) of the flexion member (30).

Figure 3:
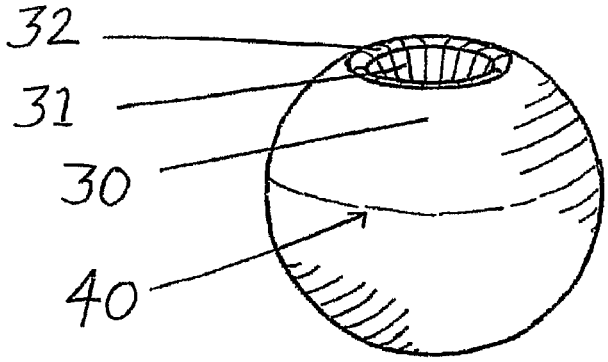
FIG. 3 is a frontal view of the preferred embodiment of flexion member with the extension member excluded.
Figure 4:
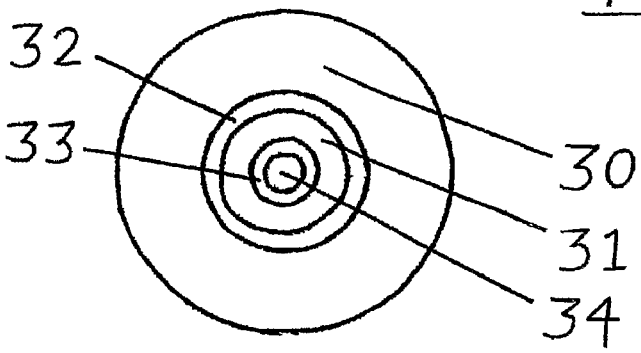
FIG. 4 is a superior view of the central flexion member with extension member excluded.

FIGS. 1, 3 and several exercise diagrams show the important horizontal mold seam line (40) in the flexion member. In order to be able to manufacture the flexion unit with the volcano exits (31, 37), the molds for the current invention must open away from the horizontal centerline of the flexion member (30), as opposed to moving away from the vertical centerline, as in prior art.

FIGS. 7, 8, 9 and 10 illustrate several examples of exercises using the inventive device in its fully assembled state.

FIG. 7 shows the device resisting the flexion or gripping action of the hand.

FIG. 8 shows the device resisting the opening and spreading action of the hand.

FIG. 9 shows the device resisting the action of wrist extension.

FIG. 10 shows the device resisting the action of finger extension and abduction.

FIGS. 11, 12, 13 and 14 illustrate several examples of exercises using the flexion member (30) of the inventive device alone.

FIG. 11 shows the ability of the device to resist a wide pinching action of the thumb and finger or fingers.

FIG. 12 shows the ability of the device to resist a narrow pinching action of the thumb and finger or fingers.

FIG. 13 shows the ability of the device to resist individual interphalangeal flexion.

FIG. 14 shows the ability of the device to resist finger adduction.

FIG. 15 shows the ability of the device to resist wide opposition.

FIG. 16 shows the ability of the device to resist narrow opposition.

FIG. 17 shows the ability of the device to resist finger and thumb extension and abduction using the extension member (20) by itself.

FIG. 18 shows the ability of the device to be adaptable for users who have injured or missing digits, or in the case where there is a need to isolate certain digits specifically for an exercise or rehabilitation.

I claim:

1. An apparatus for exercising a human hand, said apparatus comprising:

a resiliently compressible flexion member; and a resiliently extensible extension member extending through said flexion member and having holder portions with openings for receiving fingers and a thumb of a user's hand, said extension member being sized such that said openings are each located proximate a surface of said flexion member with proximal edges of said openings being substantially flush with said surface;

whereby said flexion member resists closing of said fingers and thumb in compression, and said extension member resists opening of said fingers and thumb in tension, with substantially no lull in resistance between compression and tension as said fingers and thumb are repeatedly closed and opened.

2. The hand exercise apparatus of claim 1, wherein said extension member comprises:

an elongate cord portion having said holder portions for said fingers at a first end and said holder portion for said thumb at a second end, said cord portion extending through a body of said flexion member so that said holder portions for said fingers and said holder portion for said thumb are located on opposite sides thereof.

3. The hand exercise apparatus of claim 2, wherein said flexion member has a substantially spheroidal form.

4. The hand exercise apparatus of claim 2, wherein said extension member further comprises:

a plurality of stem portions that connect said holder portions for said fingers individually to said first end of said cord portion, said stem portions converging to form a web structure proximate said first end of said cord member that is located beneath said surface of said flexion member.

5. The hand exercise apparatus of claim 4, wherein said flexion member further comprises:

a depression below said surface of said flexion member that receives said web structure of said extension member.

6. The hand exercise apparatus of claim 5, wherein said depression in said flexion member comprises:

a substantially conical depression that accommodates said web structure formed by said stem portions converging to said first end of said cord portion of said extension member.

7. The hand exercise apparatus of claim 2, wherein said flexion member further comprises:

a passage through said body of said flexion member having said cord portion of said extension member passing therethrough.

8. The hand exercise apparatus of claim 7, wherein said extension member further comprises:

a laterally extending expansion portion that engages said passage in said flexion member so as to create friction that resists slippage of the extension member within the flexion member.

9. The hand exercise apparatus of claim 7, wherein said passage through said body of said flexion member opens into an apex area of a conical depression so as to aid in locating a web formed by said stem portions of said extension member.

10. The hand exercise apparatus of claim 9, wherein said passage through said flexion member comprises:

convexly rounded surfaces at end openings where said first and second ends of the extension member exit said passage, so as to reduce wear against said flexion member during use of the said apparatus.

11. The hand exercise apparatus of claim 10, wherein said extension member further comprises:

convexly rounded surfaces on areas of said extension member that contact said flexion member, so as to reduce wear on said flexion member during use of said apparatus.

12. The hand exercise apparatus of claim 5, wherein said stem portions of said extension member having said holder portions for said fingers are curved so as to optimally situate fingers received therein for coupling resistance capabilities during extension and abduction.

13. The hand exercise apparatus of claim 1, wherein said flexion member comprises:

a body formed of resiliently compressible foam material.

14. The hand exercise apparatus of claim 2, wherein said extension member is: formed of a resilient elastomeric material.

* * * * *